US009009943B2

(12) United States Patent
Noel

(10) Patent No.: US 9,009,943 B2
(45) Date of Patent: Apr. 21, 2015

(54) TOOL FOR TRACTOR P.T.O

(76) Inventor: Roy H. Noel, Piketon, OH (US)

( * ) Notice: Subject to any disclaimer, the term of this patent is extended or adjusted under 35 U.S.C. 154(b) by 221 days.

(21) Appl. No.: 13/586,994

(22) Filed: Aug. 16, 2012

(65) Prior Publication Data

US 2013/0042452 A1 Feb. 21, 2013

Related U.S. Application Data

(60) Provisional application No. 61/575,337, filed on Aug. 19, 2011.

(51) Int. Cl.
*B25B 13/50* (2006.01)
*B25B 13/48* (2006.01)

(52) U.S. Cl.
CPC ..... *B25B 13/48* (2013.01); *Y10T 29/4978* (2015.01); *B25B 13/5008* (2013.01)

(58) Field of Classification Search
CPC ..... B25F 1/00; B25F 5/006; A01B 63/008; B25B 13/16
USPC ..... 29/456; 269/3, 6, 95, 143, 249; 81/176.1, 176.3, 119, 125, 176.2, 164, 81/175
See application file for complete search history.

(56) References Cited

U.S. PATENT DOCUMENTS

| | | | | |
|---|---|---|---|---|
| 303,219 | A * | 8/1884 | Everson | 228/57 |
| 501,177 | A * | 7/1893 | Wulf | 81/175 |
| 5,285,703 | A * | 2/1994 | Carson | 81/423 |
| 6,745,648 | B2 * | 6/2004 | Stier | 81/119 |

OTHER PUBLICATIONS (Author unknown), "Power take-off", http://en.wikipedia.org/wiki/Power_take_off, (2014) 5 pgs.

* cited by examiner

*Primary Examiner* — David Bryant
*Assistant Examiner* — Ruth G Hidalgo-Hernande
(74) *Attorney, Agent, or Firm* — Wood, Herron & Evans, LLP

(57) ABSTRACT

A tool facilitating operable interconnection between a power take off (P.T.O.) shaft and an input shaft of a driven accessory includes a wrench for engaging the splined P.T.O. shaft and turning the shaft to rotationally align with the input shaft of cooperating structure.

7 Claims, 5 Drawing Sheets

TOOL FOR TRACTOR P.T.O

PRIORITY CLAIM

Applicant claims the benefit of the filing date of Aug. 19, 2011 of its U.S. provisional patent application Ser. No. 61/575,337.

BACKGROUND OF THE INVENTION

The Power Take Off (P.T.O.) shaft, extending from a tractor or other vehicle, has many uses and can be coupled to a large variety of farm accessories, apparatus, tools, or other apparatus requiring and operating from the rotary driving force from such a P.T.O. shaft.

Typically, the P.T.O. shaft is splined for mating with a cooperatively splined coupling, hollow shaft, gear or other component on the accessory to be driven. The angular position of the P.T.O. shaft must cooperate with the angular position of the apparatus component to which it is to be coupled so the P.T.O. shaft and the implement can be engaged and thus operably connected.

Accordingly, to connect the P.T.O. shaft to such an accessory or apparatus, the P.T.O. shaft must be rotated to a complimentary angular position so its splines are aligned with the splines or coupling of the apparatus to which it is to be connected. It is typically difficult or stressful, if not impossible, to turn the P.T.O. shaft of many tractor models by hand, particularly the high horsepower models of about 100 horsepower and sometimes in the lower horsepower models as well, such as 30-50 horsepower. The shaft is driven by the tractor engine or gearing drive thereby and such gearing or engine is thereby turned when the P.T.O. shaft is turned.

It is thus one objective of the invention to provide apparatus for angularly aligning a P.T.O. shaft.

A further objective of the invention has been to facilitate coupling of an apparatus, tool or accessory to the P.T.O. shaft extending from a tractor, truck or powered farm vehicle or implement.

To these ends, a tool according to the invention includes a wrench having a U-shaped end and a handle extending from the bight or web of the U-shaped end. A space between opposed legs of the U-shaped end is wider than the outside diameter of the P.T.O. shaft with which the tool is to be used. A threaded hole is provided through at least one of the legs to receive a screw extending therethrough.

In use, the tool is placed onto a P.T.O. shaft with the legs of the U-shaped end on opposite sides of the shaft. A screw is then turned into the hole on the tool leg, with a forward screw end extending toward the P.T.O. shaft between the shaft splines By grasping and urging the handle (which extends in a radial direction from the P.T.O. shaft) in a direction about the rotational axis of the P.T.O. shaft, the shaft is easily turned by the wrench and the leverage it provides to a desired angular position for operative coupling to an implement, apparatus, tool or the like so it can then be driven upon powered rotation of the P.T.O. shaft. Even if the power system of the engine or gear train is stiff and reluctant to turn, use of such a wrench provides sufficient leverage to rotate the P.T.O. shaft to a desired angular position so it can be operatively aligned with the accessory or apparatus to be driven thereby.

Upon alignment, and preferably after initially starting the implement or its coupling onto the P.T.O. shaft, the tool of the invention is removed from the shaft by unscrewing the screw and disengaging it from the P.T.O. shaft. Alternately, the tool could be moved off the P.T.O. shaft, once the shaft is positioned and before its connection to the implement or engagement with the implement to be driven. This alignment and initial coupling, before tool removal, can be accomplished by feel, sometimes necessary due to short P.T.O. shafts of 3.5 to 4.0 inches or so, for example.

Further details of the invention are described in the written specification below and in the drawings in which.

It will be appreciated that many wrench shapes can be provided together with a variety of mechanical components to clamp and secure the wrench to a P.T.O. shaft to enable its rotation.

Nevertheless, the following is a description of but one embodiment of the invention.

Figure 1:
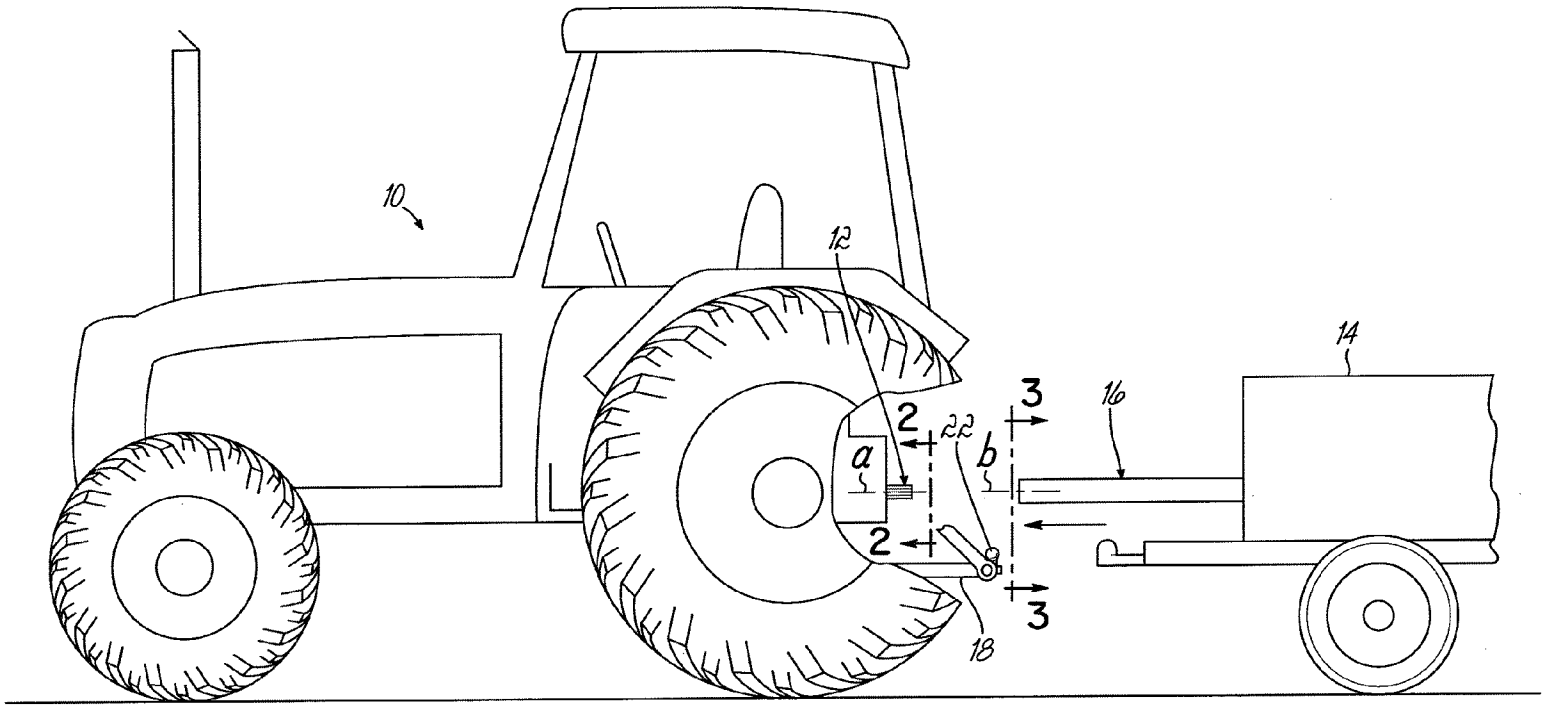
FIG. 1 is an illustrative elevational view of the invention showing the environment in which the invention is used.
Figure 1A:
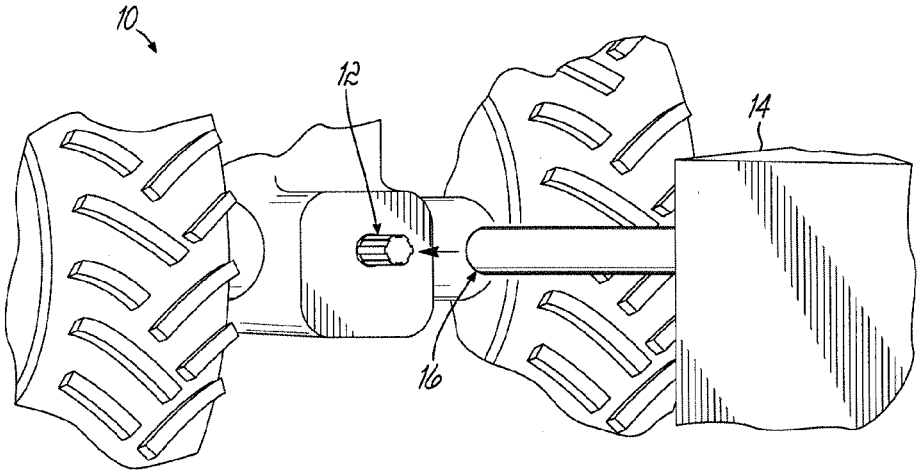
FIG. 1A is a perspective view looking into the P.T.O. area at the rear of the tractor.

Turning now to FIG. 1, there is illustrated diagrammatically therein a tractor 10 having a P.T.O. shaft 12 connected to an engine (not shown) of the tractor 10 for rotating about an axis a. it will be appreciated that while a tractor 10 is illustrated, the tractor could be a truck or any other powered vehicle supplied with a P.T.O. shaft as noted herein.

Illustrated behind tractor 10 is an implement 14 which can be a farm or agricultural apparatus, accessory or the like, requiring rotation of input shaft 16 for operation. Implement 14 can be wheeled, skidded or unwheeled, all for pulling behind tractor 10 when coupled thereto via a hitch bar 18 on tractor 10 and a tongue bar 19 on implement 14.

It will be appreciated that FIG. 1 illustrates tractor 10 and implement 14 unhitched for clarity, with any suitable hitch bar and tongue apparatus for hitching the two together, such as a coupling ball 22 on bar 18 and a ball receiving coupler 24 on tongue 19, a pin hitch, a four bar hitch or any other suitable hitching means. In the position of FIG. 1, the implement 14 has not been coupled to tractor 10, nor has the P.T.O. shaft 12 been operatively coupled to input shaft 16.

Figure 2:
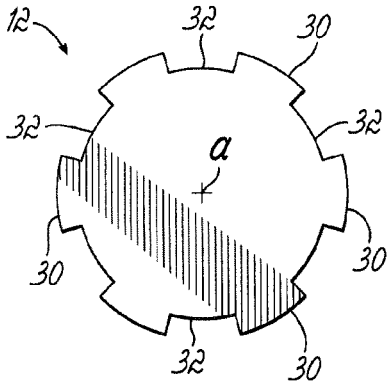
FIG. 2 is a cross-sectional view taken along lines 2-2 of FIG. 1.

Turning now to FIG. 2, there is illustrated a cross-sectional view of a P.T.O. shaft 12 having a plurality of splines 30 separated by grooves 32. In the embodiment shown, there are six equal-sized, equally spaced apart splines 30 and grooves 32.

Figure 3:
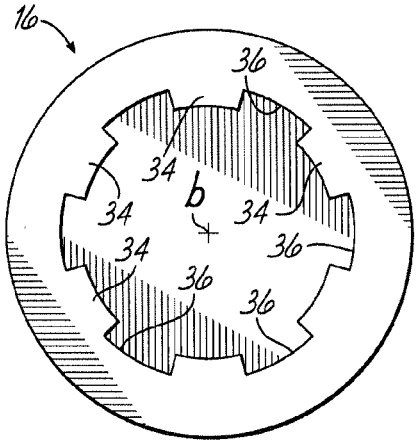
FIG. 3 is a cross-sectional view taken along lines 3-3 of FIG. 1.

In FIG. 3, there is illustrated a cross-sectional view of a hollow input shaft 16 having a plurality of inwardly directed, equally sized and spaced apart splines 34 and separate grooves 36 about axis b. Input shaft 16 can be operably coupled to P.T.O. shaft 12 when axes a and b are coaxially aligned and when P.T.O. shaft 12 is aligned on axis a complimentarily and rotationally indexed to the angular position of input shaft 16 on axis b.

In other words, P.T.O. shaft 12 can be inserted into input shaft 16 when the splines 30 of P.T.O. shaft 12 are aligned with grooves 36 of input shaft 16. In this condition, inward splines 34 of input shaft 16 are aligned with grooves 32 of P.T.O. shaft 12. It is this alignment which is facilitated by the invention herein.

Figure 4:
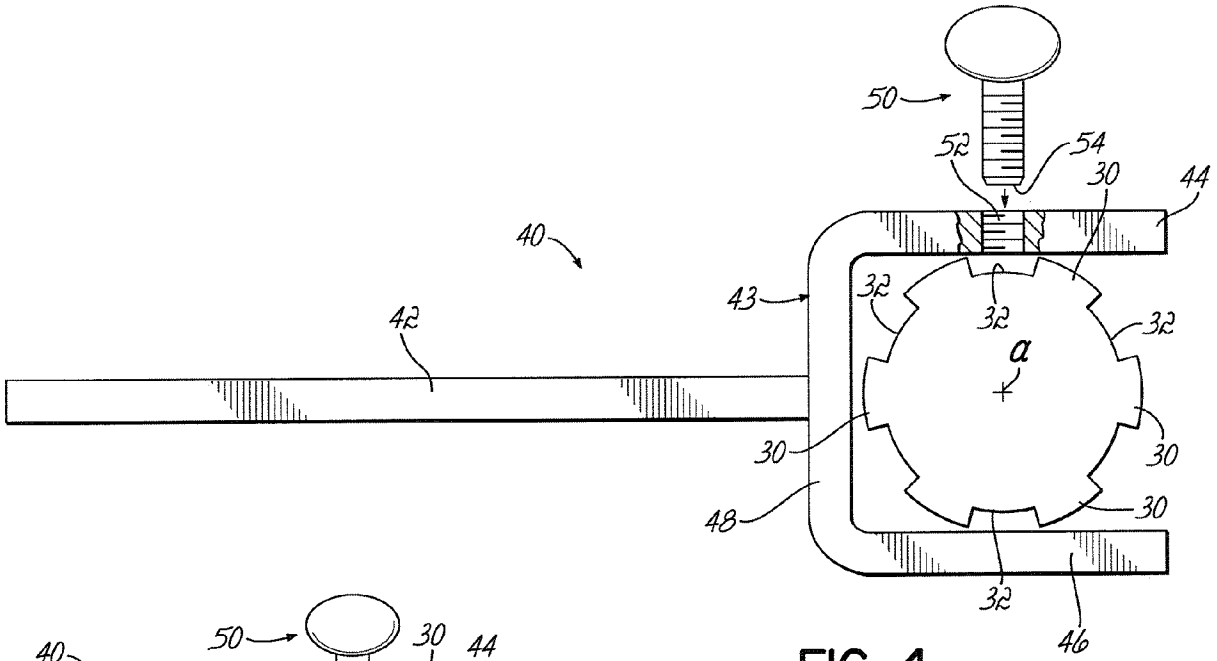
FIG. 4 is a side elevational view of a tool of the invention in position around a P.T.O. shaft but with the attaching screw shown removed for clarity.

Turning now to FIG. 4, the invention is illustrated comprising a P.T.O. wrench 40 having a handle 42 on a U-shaped, P.T.O. shaft engaging end 43. End 43 has two opposed legs 44, 46 and a bight or base 48 extending therebetween. Handle 42 is welded or otherwise attached to end 43 for applying torque to end 43 and shaft 12.

A thumb screw, such as at 50, is threadable into a threaded bore 52 in leg 44 and opposite leg 46. Screw 50 has an end 54 which is translated through bore 52 toward and into a groove 30 between two splines 32 on P.T.O. shaft 12. Screw 50 can be tightened against. P.T.O. shaft 12 to secure wrench 40 onto P.T.O. shaft 12 both longitudinally (with respect to axis a) and rotationally by virtue of the engagement of screw ends 54 in a groove 30 between adjacent splines 32. The screw 50 is shown spaced from bore 52 and P.T.O. shaft 16 in FIG. 4 for clarity.

Figure 4A:
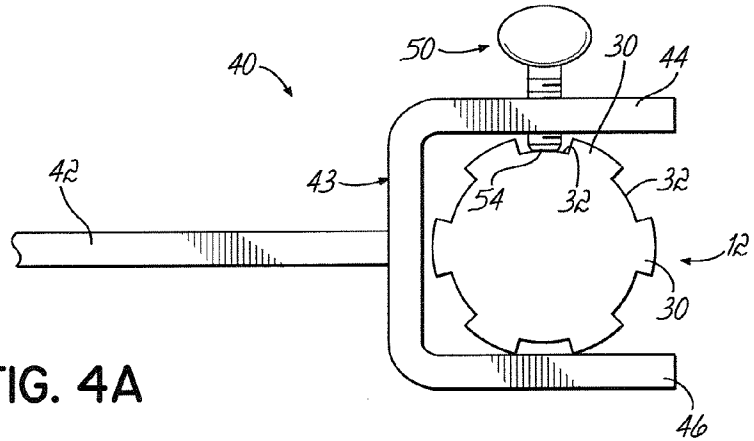
FIG. 4A is a view like FIG. 4 but showing the invention with attaching screw engaged with the shaft 12.
Figure 5:
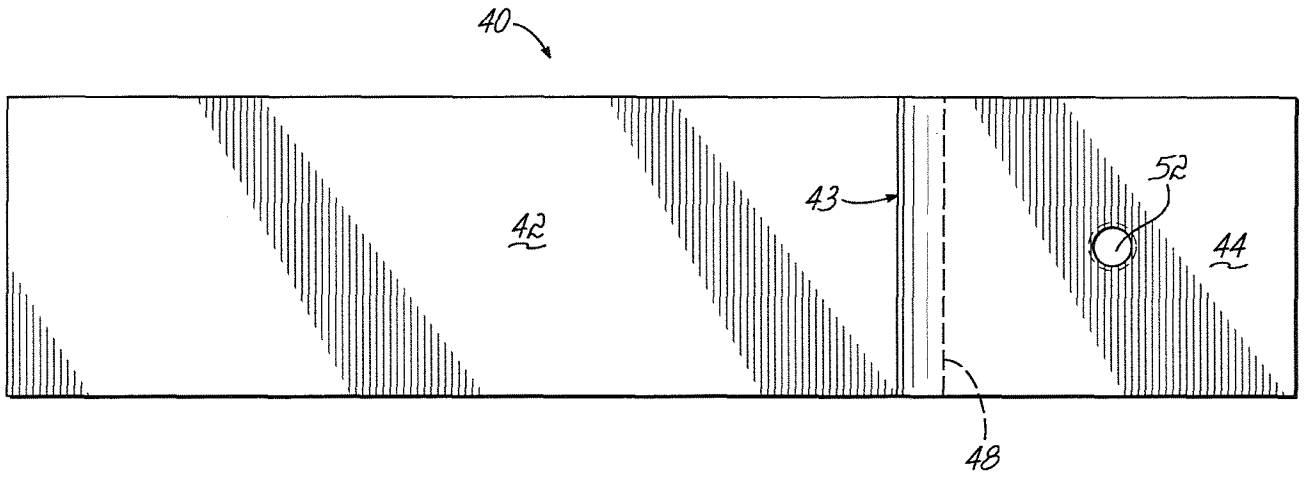
FIG. 5 is a top view of the wrench of FIGS. 4 and 4A.
Figure 6:
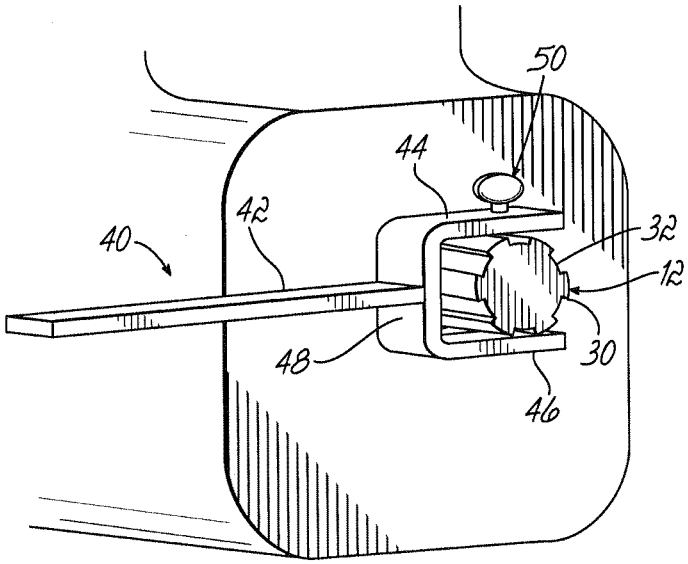
FIG. 6 is an isometric view of the wrench tool on a P.T.O. shaft.
Figure 7:
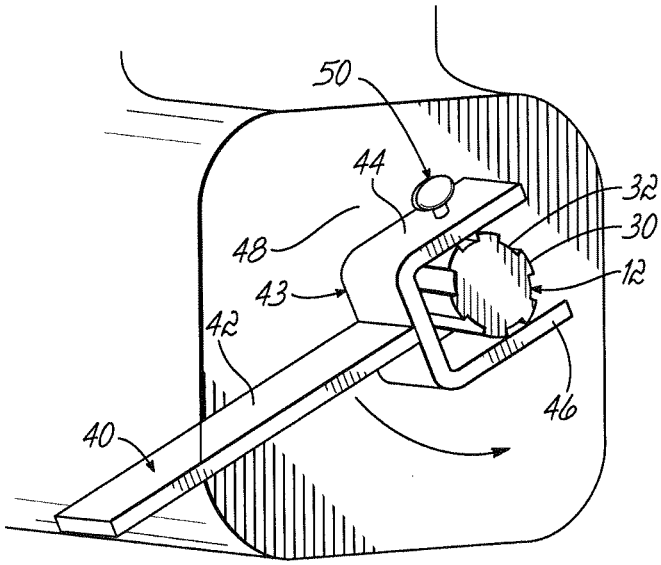
FIG. 7 is a view similar to FIG. 6 but showing the tool having turned the P.T.O. shaft in a counterclockwise direction, for example.

FIG. 6 illustrates the secured position of wrench 40 on P.T.O. shaft 12, while FIG. 7 illustrates the rotation of P.T.O. shaft 12 by wrench 40 about 30 degrees, for example. In FIGS. 6, 7 and 4A, screw 50 has tightened wrench 40 on shaft 12 so the wrench leg 46 engages the shaft on the opposite side from leg 44 and screw 50. Shaft 12 can be rotated more or less as necessary for alignment desired with input shaft 16.

In use, wrench 40 is affixed to shaft 12 and manually rotated about axis a through an angular range sufficient to rotate P.T.O. shaft 12 to a rotational position (FIG. 7) such that splines 30 of it align with the angular position of grooves 36 of shaft 16 when axes a and b are aligned coaxially. Once that complimentary orientation is produced through the use of wrench 40, P.T.O. shaft 12 is moved relative to input shaft 16 so to couple the two together.

While FIG. 7 illustrates the turning of a P.T.O. shaft 12 through about 30 degrees, that rotational movement could be more or less as needed for the intended alignment.

It should also be noted that the relative movement of P.T.O. shaft 12 and input shaft 16 can be accomplished by backing tractor 10 toward the implement 14, or moving implement 14 toward tractor 10, not only for the coupling of the shafts but for coupling the tractor 10 to the implement 14 for pulling through a hitch mechanism described above (22, 24).

Moreover, it will be appreciated that while input shaft 16 has been described as a hollow shaft, a separate coupling sleeve (not shown) reciprocably (but not rotatably) movable on a shaft 16, and having the spline and groove features of shaft 16, could be used. For example, a coupling member attached to an input shaft 16 could be extended therefrom to engage P.T.O. shaft 12. Accordingly, reference to an input shaft 16 herein encompasses an input shaft having a coupling member thereon for operatively engaging P.T.O. shaft 12.

Once the P.T.O. shaft 12 is properly rotationally aligned, screw 50 is loosened and wrench 40 removed from P.T.O. shaft 12. This can occur just prior to engagement of the shafts 12, 16 or thereafter.

Accordingly, the invention provided herein facilitates the job of an operator of equipment requiring connection between a P.T.O. shaft and the input shaft of an implement. Tractors and implements or farm accessories are much more easily connected and set up for use without the disabilities, time and complexities required in the past.

Wrenches according to the invention can be made in any size or shape for particular application, varying shaft sizes, and varying P.T.O. environments.

These and other modifications and variations of the invention will be readily appreciated by the foregoing to those of ordinary skill in the art without departing from the scope of the invention and applicant intends to be bound only by the claims appended hereto.

What is claimed is:

1. In combination, a splined power take off shaft, a complimentary but hollow driver input shaft, and a tool for rotating said power take off shaft into a position for coupling to said input shaft of a hollow driven member, said splined power take off shaft having a plurality of elongated exterior splines spaced apart by a plurality of respective elongated grooves and said complimentary driven member having a plurality of internal elongated splines and grooves said splines of said complimentary driven member operatively engageable with the grooves of said power take off shaft, and said grooves of said complimentary driven member oriented for receiving the splines of said power take off shaft, and said tool comprising:

a U-shaped wrench end having two legs fixed in spatial orientation with respect to each other and a web joining ends of said legs;

a handle extending from said web;

a hole through one of said legs; and a screw in said hole extending and moveable toward and away from the other of said legs into one of said grooves of said power take off shaft and engaging with a spline of said power take off shaft and operable for turning said shaft upon rotational movement of said tool.

2. The combination of claim 1 wherein said splined power takeoff shaft has an axis of rotation and wherein said screw is aligned perpendicularly to said axis of rotation of said power take off shaft.

3. The combination of claim 2 wherein said screw has an end portion extending into a groove of said power takeoff shaft such that a spline of said power takeoff shaft engages a radial periphery of said screw end portion.

4. The combination of claim 1 wherein said screw is oriented perpendicularly to each of said legs.

5. A method of angularly adjusting a power take off shaft having a shaft oriented about an axis of rotation and a plurality of radially oriented elongated splines spaced by grooves therebetween with respect to a complimentary driven shaft and comprising the steps of:

engaging said shaft with a wrench having opposed legs on opposite sides of said shaft said legs of said wrench being in fixed relation to each other;

extending a screw through one of said legs in a direction perpendicular to another of said legs and into a space between splines of said power takeoff shaft; with said screw engaging a spline;

turning said power take off shaft about said axis of rotation thereof by manipulating said wrench in a circular direction about said shaft axis of rotation and operably aligning said shaft with said driven shaft; and moving one of said shafts in a direction parallel to said axis into engagement with said other shaft.

6. A method as in claim 5 including the steps of angularly adjusting said power take off shaft into an angular position such that splines of said shaft are longitudinally aligned with grooves within said driven shaft.

7. A tool for rotating a splined power take off shaft into a position for coupling to a hollow driven input shaft radially extending, said splined power take off shaft having a plurality of elongated, radially extending exterior splines spaced apart by a plurality of respective elongated grooves and said driven member having a plurality of internal elongated splines and grooves, said splines of said driven member for cooperation with the grooves of said power take off shaft, and said grooves of said driven member oriented for receiving the splines of said power take off shaft, said tool comprising:

a U-shaped wrench end having two legs for disposition about said power take off shaft, and a web joining ends of said legs;

said legs in fixed, parallel relationship to each other;

a handle extending from said web;

a hole in one of said legs; and a screw in said hole extending and moveable perpendicularly toward and away from another of said legs and into one of said grooves of said power take off shaft for engagement with said power take off shaft and for turning said shaft upon rotational movement of said tool to align said splines of said power take off shaft with internal grooves of said driven member, and wherein said power take off shaft is rotatable about an axis of rotation and wherein said screw is moveable in a direction toward said axis when said tool is disposed thereabout.

* * * * *